United States Patent [19]

Papavergos

[11] Patent Number: 5,014,790

[45] Date of Patent: May 14, 1991

[54] METHOD AND APPARATUS FOR FIRE CONTROL

[75] Inventor: Panayiotis G. Papavergos, Woking, England

[73] Assignee: The British Petroleum Company plc, London, England

[21] Appl. No.: 259,067

[22] Filed: Oct. 18, 1988

[30] Foreign Application Priority Data

Oct. 24, 1987 [GB] United Kingdom ..... 8724973

[51] Int. Cl.[5] ..... A62C 35/00

[52] U.S. Cl. ..... 169/44; 169/14; 169/15; 239/432; 239/424.5; 239/429

[58] Field of Search ..... 169/44–47, 169/62, 9, 14, 15, 37, 91, 85, 74; 239/432, 434, 424.5, 425.5, 434.5, 429, 428.5

[56] References Cited

U.S. PATENT DOCUMENTS

| | | | |
|---|---|---|---|
| 571,940 | 11/1896 | Binford | 169/37 X |
| 1,148,763 | 8/1915 | Fagan | 169/44 |
| 2,213,122 | 8/1940 | Göhre | 169/14 X |
| 2,259,500 | 10/1941 | Thompson | 169/14 |
| 2,646,314 | 7/1953 | Peeps | 299/140.1 |
| 2,832,425 | 4/1958 | Jacobs | 169/85 X |
| 3,033,292 | 5/1962 | Browning | 169/44 |
| 3,342,271 | 9/1967 | Anthony, Jr. | 169/15 |
| 3,421,693 | 1/1969 | Fraser | 239/15 |
| 3,465,827 | 9/1969 | Levy et al. | 169/62 X |
| 3,498,028 | 3/1970 | Trouw | 55/237 |
| 3,604,509 | 9/1971 | Sachnik | 169/15 |
| 3,814,326 | 6/1974 | Bartlett | 239/276 |
| 3,831,682 | 8/1974 | Rockwell | 169/37 |
| 3,907,206 | 9/1975 | Kondo | 239/357 |
| 4,020,904 | 5/1977 | DePalma | 169/74 |
| 4,154,304 | 5/1979 | Steibing et al. | 169/74 |
| 4,248,733 | 2/1981 | States | 169/47 X |
| 4,254,833 | 3/1981 | Perry | 169/76 |
| 4,284,239 | 8/1981 | Ikeuchi | 239/8 |
| 4,333,610 | 6/1982 | Clements | 239/601 |
| 4,390,069 | 6/1983 | Rose, Jr. | 169/15 |
| 4,415,123 | 11/1983 | Ikeuchi | 239/425 |
| 4,511,087 | 4/1985 | Matsumoto | 239/433 |
| 4,585,173 | 4/1986 | Soule | 239/433 |
| 4,653,693 | 3/1987 | Steingass | 239/460 |
| 4,681,263 | 7/1987 | Cockman | 239/391 |
| 4,779,801 | 10/1988 | O'Donnell | 169/91 X |

FOREIGN PATENT DOCUMENTS

| | | | |
|---|---|---|---|
| 952396 | 8/1974 | Canada . | |
| 0232495 | 8/1987 | European Pat. Off. . | |
| 0240377 | 10/1987 | European Pat. Off. . | |
| 314354 | 5/1989 | European Pat. Off. | 169/15 |
| 711263 | 8/1941 | Fed. Rep. of Germany | 169/15 |
| 1557203 | 4/1970 | Fed. Rep. of Germany . | |
| 1559665 | 4/1974 | Fed. Rep. of Germany . | |
| 1559624 | 12/1974 | Fed. Rep. of Germany . | |
| 2819666 | 11/1979 | Fed. Rep. of Germany . | |
| 3440901 | 7/1985 | Fed. Rep. of Germany . | |
| 2205164 | 6/1974 | France . | |
| 2221660 | 10/1974 | France . | |
| 2309283 | 12/1976 | France . | |

(List continued on next page.)

OTHER PUBLICATIONS

Modified Jet Engine to Fight Mine Fires, Coal Age, Jun., 1984, p. 79.

*Primary Examiner*—Joseph F. Peters, Jr.
*Assistant Examiner*—James M. Kannofsky

[57] ABSTRACT

Method and apparatus for fire control comprising the use of a gas-liquid twin fluid spray nozzle. In one embodiment the spray nozzle comprises a mixing chamber having a gas inlet and one or more outlets at opposite ends, two or more liquid inlets between the gas inlet and the outlets and a mixing zone between the liquid inlets and the outlets. In another embodiment the spray nozzle comprises a mixing chamber having a plurality of gas inlets, liquid inlets and outlets, the inner surface of the mixing chamber being capable of aiding mixing of gas and liquid introduced through the inlets.

The nozzles may be used in fixed, portable or semi-portable fire control systems.

17 Claims, 7 Drawing Sheets

FOREIGN PATENT DOCUMENTS

Figure 1:
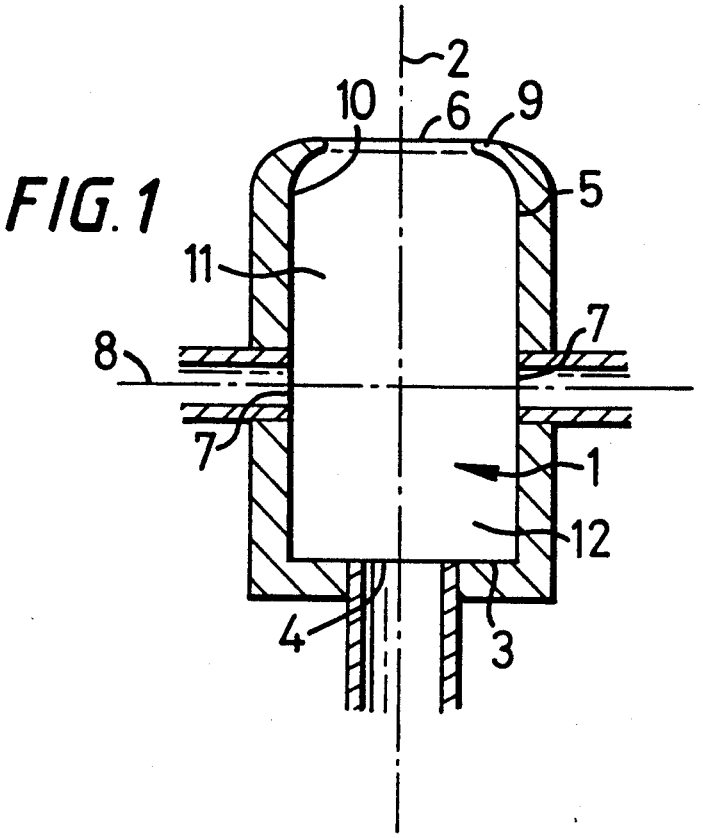

| | | | |
|---|---|---|---|
| 2442640 | 6/1980 | France . | |
| 2588348 | 10/1985 | France . | |
| 2575082 | 6/1986 | France | 169/15 |
| 200217 | 3/1983 | German Democratic Rep. . | |
| 233490 | 3/1986 | German Democratic Rep. . | |
| 526820 | 5/1955 | Italy | 169/15 |
| 55-49162 | 4/1980 | Japan . | |
| 051024 | 12/1981 | Japan . | |
| 57-42362 | 3/1982 | Japan . | |
| 186317 | 10/1983 | Japan . | |
| 7215931 | 5/1974 | Netherlands . | |
| 7410257 | 3/1976 | Sweden . | |
| 467980 | 6/1976 | U.S.S.R. . | |
| 698629 | 11/1979 | U.S.S.R. . | |
| 1263262 | 10/1980 | U.S.S.R. . | |
| 856569 | 8/1981 | U.S.S.R. . | |
| 866228 | 9/1981 | U.S.S.R. . | |
| 878315 | 11/1981 | U.S.S.R. . | |
| 910163 | 3/1982 | U.S.S.R. . | |
| 995811 | 2/1983 | U.S.S.R. . | |
| 995816 | 2/1983 | U.S.S.R. . | |
| 1155272 | 5/1985 | U.S.S.R. . | |
| 1189458 | 11/1985 | U.S.S.R. . | |
| 1233878 | 5/1986 | U.S.S.R. . | |
| 1243745 | 7/1986 | U.S.S.R. . | |
| 1243746 | 7/1986 | U.S.S.R. . | |
| 871736 | 6/1961 | United Kingdom | 169/9 |
| 1194203 | 6/1970 | United Kingdom . | |
| 1412133 | 10/1975 | United Kingdom . | |
| 1424191 | 2/1976 | United Kingdom . | |
| 1470671 | 4/1977 | United Kingdom . | |
| 1585281 | 2/1981 | United Kingdom . | |
| 1585282 | 2/1981 | United Kingdom . | |
| 2084903 | 4/1982 | United Kingdom . | |
| 2139495 | 11/1984 | United Kingdom . | |
| 2162769 | 2/1986 | United Kingdom . | |

METHOD AND APPARATUS FOR FIRE CONTROL

This invention relates to fire control and in particular to method and apparatus for fire control by use of one or more spray nozzles.

Fire control may comprise one or more of the following activities; extinguishing a fire, limiting the development or spread of a fire, cooling the fire and its environs, cooling areas adjacent to the fire, increasing the survivability of an enclosed space by stripping smoke, fumes and the like from the space, reducing flame radiation intensity and other activities. Sprays of non-flammable liquid may be used in fire control.

Liquid drop size distribution in a fire control spray is of paramount importance in fire control. Coarse drops of non-flammable liquid used to extinguish or cool fires have higher penetration into the core of the fire than fine drops, but may flood part of the fire. Water based liquids when engulfed in the intense temperature zones of flames, may be brought to boiling rapidly and subsequently vaporise violently with explosion, thus spreading the fire (a situation with devastating consequences particularly in crude oil fires). Fine drops may fall short of penetration into the core of the fire because most of them vaporise en route to the fire with very little temperature reduction effect. Too fine drops may also be a hazard to operators and equipment, because they strip down a considerable amount of the smoke produced, thereby intensifying the fire (i.e. they produce more radiant flames). Both types of drops; coarse and fine, produce steam, which being of higher vapor pressure than just atmospheric air, may be a hazard, particularly in confined fire situations.

It is generally difficult to achieve a spray of liquid drops of a suitable size for fire control with the necessary range or "throw" using conventional single fluid spray nozzles. Most known single fluid fire control nozzles require high back pressures to achieve sprays with long throws (e.g. pressures ranging from 10 to 30 barg to achieve throws of about 10 m in still air conditions). Apart from imposing heavy loads on the liquid supplying pumps, these nozzles may limit the operator's mobility (in the case of hand held nozzles for mobile fire control). To achieve long throws a solid jet is required to be formed by the nozzle, the spray from which covers only a limited area of the fire concerned, and is thus normally used for extinguishing isolated pockets of fires. Long throw single fluid spray nozzles tend to produce sprays of coarse drops of liquid because they rely upon the ambient air to break up the liquid. Spray jet type nozzles produce sprays having shorter throws. These cover a much wider area of the fire, and are normally used for reducing the intensity/temperature of the fire in the early stages of fire control. Short throw spray jet type nozzles tend to produce sprays of finer drops of liquid. Some single fluid spray nozzles, used for mobile fire control, can operate in both modes, i.e. as solid jet or spray jet.

However, it has been found that by using a gas-assisted, spray nozzle, a spray having liquid drops of suitable size for fire control and with the desired throw can be achieved.

Thus, according to the present invention there is provided a method of fire control by use of a spray nozzle, comprising supplying to the spray nozzle separately and under pressure, non-flammable gas and non-flammable liquid, the spray nozzle having a mixing chamber with at least one gas inlet, at least one liquid inlet and at least one outlet, and directing the resultant spray emerging from the outlet to control the fire.

According to the present invention there is also provided a spray nozzle for use in fire control, the nozzle comprising a mixing chamber having at least one inlet for pressurised, non-flammable gas, at least one inlet for pressurised, non-flammable liquid and at least one outlet for the resultant spray.

According to the present invention there is also provided apparatus for use in fire control, the apparatus comprising one or more spray nozzles having mixing chambers with at least one gas inlet, at least one liquid inlet and at least one outlet, and means for supplying pressurised, non-flammable gas to the gas inlets, and means for supplying pressurised, non-flammable liquid to the liquid inlets. The apparatus may be in the form of a fixed installation, semi-portable or portable.

In a first embodiment of the present invention the method and apparatus may be used for fixed or mobile fire control using a spray having a relatively long throw. In this embodiment the spray nozzle comprises a mixing chamber, preferably cylindrical in shape, having a gas inlet and one or more outlets, the gas inlet and the outlets being at opposite ends of the mixing chamber, the mixing chamber having two or more liquid inlets between the gas inlet and the outlets, and the mixing chamber having a zone between the outlets and the liquid inlets for the gas and liquid to mix. Preferably, the mixing chamber has a second zone between the gas inlet and the liquid inlets. Preferably the liquid inlets are equally spaced circumferentially around the mixing chamber. Preferably, the liquid inlets are in a common plane perpendicular to the axis of the mixing chamber. The liquid inlets may be directed skew with respect to the axis of the mixing chamber but are preferably directed radially with respect to the axis. Preferably, there is a single outlet which is narrower than the mixing chamber, thereby defining a lip at the outlet and the mixing chamber has an inner surface which is contiguous with the lip. The outlet may have a spray shaping or modifying device. The nozzle may have a plurality of outlets directed to produce a spray of the required shape and throw. The mixing chamber may have more than one gas inlet but preferably has fewer gas inlets than liquid inlets.

In use, pressurised, non-flammable gas is supplied to the gas inlet at sufficiently high pressure to achieve ultimately a spray with the desired quality and throw and pressurised, non-flammable liquid is supplied to the liquid inlets. It is believed that the pressurised gas entering the mixing chamber shears the liquid entering through the liquid inlets and entrains most of the liquid to give a liquid dispersion in the gas in the zone between the liquid inlets and the outlets. As this dispersion leaves the mixing chamber through the outlets it expands to form a spray of liquid drops. Preferably, the relative locations of the inlet ports and the pressure/flow characteristics of the gas and liquid are adjusted so that recirculation of the dispersion does not take place in a second zone, between the liquid inlets and the gas inlet. In the embodiment comprising a nozzle having a lip, it is believed that liquid that coalesces on the inner surface of the mixing chamber and in the first zone tends to be returned to the mixing chamber to be subsequently dispersed in the spray.

In a second embodiment of the present invention the method and apparatus may be used for fire control using a spray having a relatively short throw and with relatively low gas and liquid throughputs. In this embodiment the spray nozzle comprises a mixing chamber having a plurality of liquid inlets, a plurality of gas inlets and a plurality of outlets. The mixing chamber also has an inner surface capable of aiding mixing of gas and liquid introduced through the inlets. The shape of the surface urges the gas and liquid to come together after they have impinged on one another thereby, it is believed, the gas rarifies the liquid, which is believed to be the early stage of drop formation. Preferably, the inlets are directed so that gas and liquid flows through the inlets impinge on one another to mix within the mixing chamber and to avoid unmixed gas or liquid leaving the mixing chamber. Preferably the outlets are equally disposed circumferentially around one end of a longitudinal axis of the mixing chamber. The outlets may be positioned to provide a spray of a given shape. Preferably, the gas inlets are disposed circumferentially around the mixing chamber. Preferably, the liquid inlets are disposed circumferentially around the mixing chamber. The liquid inlets may be radially outside the gas inlets or the gas inlets may be radially outside the liquid inlets. This interchangeability offers advantages of scaling the nozzle for different applications. Preferably, the gas inlets are radially outside the liquid inlets. There may be more radially outer inlets than radially inner inlets.

In use, a non-flammable liquid is supplied to the liquid inlets and a non-flammable gas is supplied to the gas inlets at sufficiently high pressure to achieve ultimately a spray having the desired quality and throw. It is believed that the gas and liquid are mixed in the mixing chamber preferably, by shear and recirculation and then leave the chamber through the outlets in the form of a spray. The spray may be in the form of a hollow cone and the spray angle is defined as the angle between two longitudinal axes of any two diametrically opposed outlets.

In the method of the present invention, the gas is preferably air but other gases such as nitrogen, carbon dioxide or mixtures of air and nitrogen or even halon may be used. Preferably, the liquid is water or a water solution. However, it is envisaged that other liquids may be used such as non-flammable fire extinguishing liquids, for example, water solutions containing fire suppressants or dousing agents.

Without washing to be bound by any theory as to the working of the spray nozzle according to the present invention, it has been found that the throw and drop size distribution of the spray is dependent upon such factors as the pressure inside the mixing chamber, the pattern of mixing in the mixing chamber, the spray angle and the throughput of gas and liquid through the nozzle. It is believed that the extent of mixing of the gas and liquid in the spray nozzle is dependent upon inter alia the size of the mixing chamber, interaction of the gas and liquid in the mixing chamber, the pressure and flow characteristics of the gas and liquid and to a lesser extent on the shape of the mixing chamber. Thus for example, the more thorough the mixing of the gas and liquid in the mixing chamber, the smaller the liquid drops in the resultant spray. Fine sprays, that is small liquid drops, tend to be produced when the pressure in the mixing chamber is relatively high and the size of the mixing pattern is such as to minimise coalescence of the drops before they leave the chamber. When the mixing chamber is operated at a lower pressure the mass throughput of gas must be increased to achieve a spray having liquid drops as small as in high pressure operation. It has been found that increasing gas flow or pressure above a certain optimum has little benefit in producing sprays with smaller liquid drop size. Coarse sprays, that is sprays with large liquid drops, may be produced by using less gas and/or allowing increased coalescence in the mixing chamber when high pressures are used.

It is believed that when the spray is being directed at a fire in fire control the spray has the necessary throw to effect satisfactory fire penetration and that the drops, although they lose weight due to evaporation on leaving the nozzle and before reaching the fire core, retain their liquid state as they reach the fire core. This allows substantial heat absorption from the fire as the liquid drops evaporate, particularly in the case of water based liquids having a high latent heat of evaporation and high heat capacity. It is believed that the water-based spray, in addition to providing a large and rapid reduction in temperature of the fire core, also, once it has changed to vapor in the hot environment, provides water molecules which may narrow the flammability limits of the combustibles in the fire core by inhibiting the combustion reactions at the molecular level. It is also believed that the temperature reduction effect helps prevent re-ignition of the fire. For liquid hydrocarbon based fires, formation of a water-oil emulsion, which may be enhanced by stripped smoke particles, may also help prevent re-ignition.

It is envisaged that the fire control method and apparatus of the present invention may have numerous applications and uses. The apparatus may be in the form of fixed installations eg. in buildings or vehicles, in the form of semi-portable installations eg. fire control hoses or in the form of portable equipment eg. portable fire extinguishers.

Thus the method and apparatus according to the present invention using a spray having along throw may be used to control relatively large fires by mobile attack or by fixed installations. This method may be particularly beneficial in controlling oil fires by use of a spray of liquid drops of a suitable size to reduce the danger of possible explosion caused by violent vaporisation of a water based liquid that builds up and is engulfed in the fire core.

The method and apparatus according to the present invention using a spray having a short throw may be used for fixed, mobile or portable fire control in a confined space wherein a number of spray nozzles may be provided for fire control over a large area of the confined space, the nozzles having a suitable throw and being arrayed according to the geometry of the confined space and the likely nature of the fire. The confined space may be the interior of a vehicle such as an aircraft, the interior of a building or of a tunnel. During a fire emergency in a confined space the risk to life is particularly acute because of the limited time available for trapped personnel to escape before heat, smoke, noxious fumes and the lack of oxygen render the environment uninhabitable. The hazards are further increased by the high risk of a fire front (flashover) developing and by the possibility of the fire spreading, which may cut off escape routes or may even result in explosions of, for example, fuel if the confined space is a vehicle such as an aircraft. These hazards have been tragically illustrated in recent incidents involving aircraft fires. It is believed that the present invention provides a method of fire control by means of extinguishing a fire in the early stages of development or of limiting the spread of an established fire using a limited liquid supply. By using a supply of clean, cool air as the gas supply to the spray nozzle it is believed that the present invention has the further advantages of supplying cool gas to further reduce the temperature inside the confined space and providing air to improve the breathability of the environment for persons in the confined space. This is particularly the case if by suitable positioning of the nozzles in the confined space the water drops are propelled towards the fire, but the air tends to lose its momentum as it imparts its kinetic energy to the liquid and instead of feeding the fire tends to stay in the environs of the nozzle to assist the survivability of the environment for the individuals in the confined space. This may also be beneficial for portable or semi portable apparatus which are operated by an individual.

It is further envisaged that when the method and apparatus according to the present invention is applied to confined spaces, the supply of gas and/or liquid may be used to drive pumps or extractors capable of extracting hot gases and vapors from the confined space. The spray nozzles may be supplied directly by the liquid and/or gas or alternatively, they may be supplied by the liquid and/or gas after it has passed through the pumps or extractors. It is also envisaged that the pumps or extractors may be driven indirectly by the gas and liquid. THus if the confined space is pressurised, for example an aircraft cabin, and air/water are used, the air and water vapor produced by vaporisation of the water spray may lead to an increase in the pressure of the confined space. This pressure may be regulated by means comprising letting down the pressure through the extractors or aircraft pressurisation system thereby removing hot noxious fumes and vapor from the confined space. The pumps or extractors and spray nozzles may be associated together in single units or alternatively, they may be positioned separately, for example. The spray nozzles may be located above a region of high fire risk and the pumps or extractors may be located at a high point, where hot noxious fumes are likely to collect.

The relatively small amount of liquid required in the spray nozzle according to the present invention having a relatively short throw makes this embodiment particularly suitable for use in vehicles and the like where a limited amount of liquid is available. In this embodiment the liquid supply for the spray may be derived from the on-board water supply to allow operation when the vehicle is in motion. The gas supply may be similarly derived from the vehicle's own compressed gas supply. Pumps or extractors, if present, may exhaust into the vehicle's air conditioning vents or extraction vents. Vehicles to which this invention may be applied include trains, tanks and armored vehicles and the like, ships, hovercraft, submarines and, most preferably, aircraft. Thus, in the event of a fire on an aircraft whilst it is on the ground at an airport, for example, the development or spread of the fire may be limited by utilising services (air and water) available from within the aircraft. This provides valuable time during the initial stages of a fire for passengers and crew to escape prior to the arrival of any emergency services. It is envisaged that the water could be supplied at pressure by means of pressurised air from a receiver in the event of power failure in the vehicle. It is envisaged that the limited amount of water available and the compressed air supply on the aircraft could be augmented by the emergency services upon their arrival, in addition to the conventional fire control procedures that would be implemented.

In another embodiment of the present invention the method and apparatus may be applied to confined spaces where the use of excessive amounts of liquid, such as might be required in conventional fire control, is to be avoided. Such an embodiment may include tunnels, mines and other underground workings, where excessive amounts of liquid may cause problems of flooding or may include situations where electrical hazards are present. In this embodiment the spray nozzles may have long or short throw sprays as appropriate and may be provided as fixtures within the tunnel itself or, may be associated with vehicles travelling through the tunnel. Thus, for example, trains travelling through the tunnel may be equipped with spray nozzles deriving their liquid and gas supplies from the train and being positioned in areas of highest fire risk such as wagons or carriages transporting vehicles or flammable liquid.

In yet a further embodiment of the present invention, the method and apparatus may be applied where it is desirable to minimise damage due to excess liquid usage, for example hotels, warehouses and the like.

The invention will now be described by way of example only and with reference to the accompanying drawings.

Figure 2:
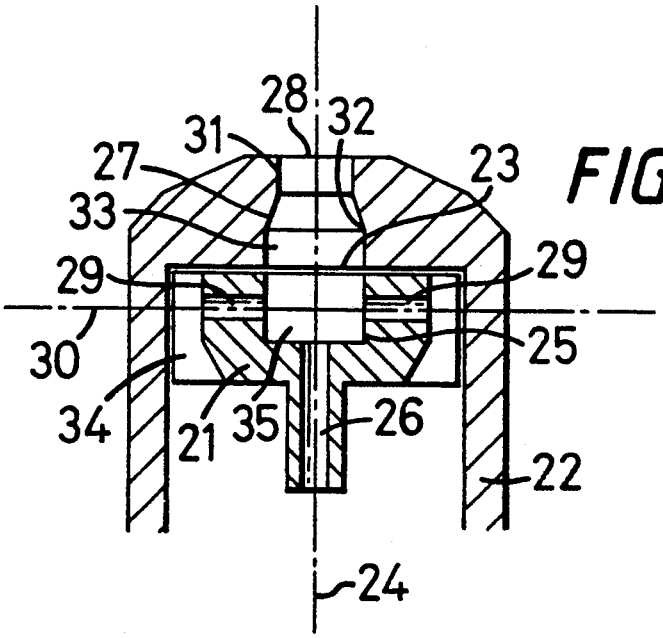
Figure 3:
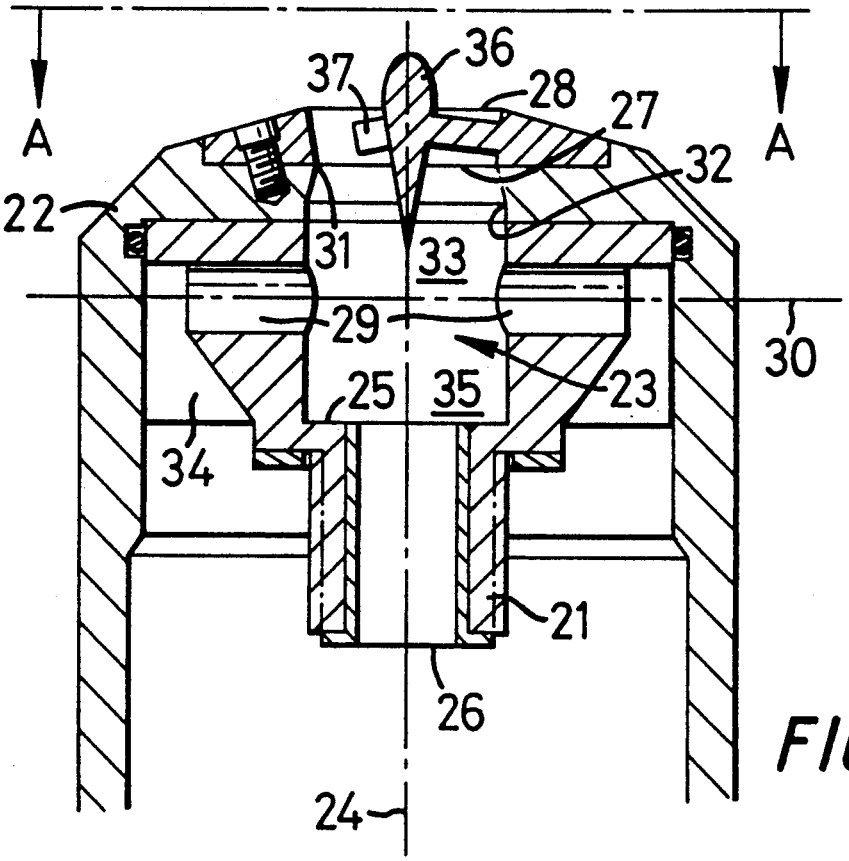
Figure 4:
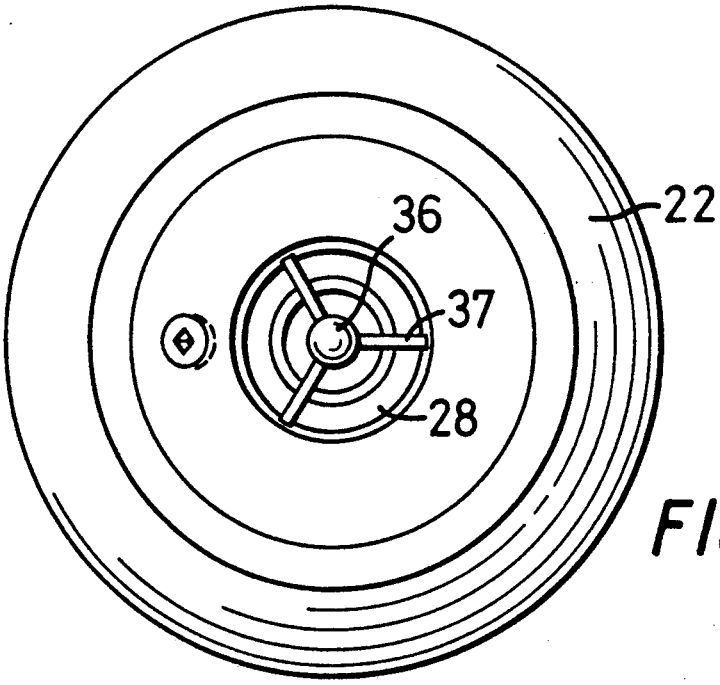
Figure 5:
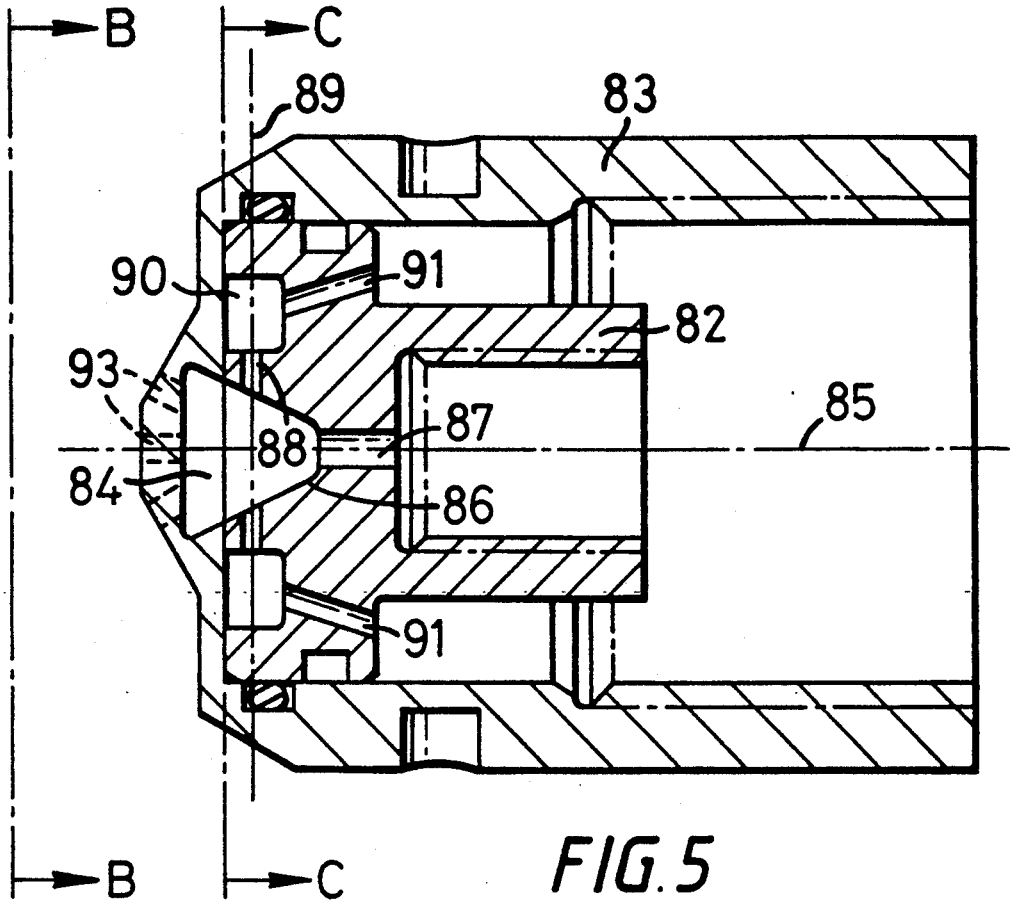
Figure 6:
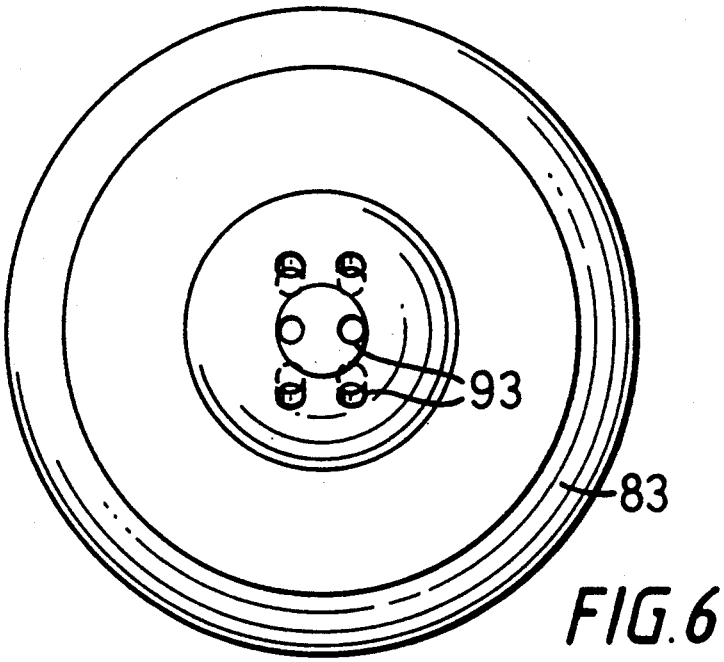
Figure 7:
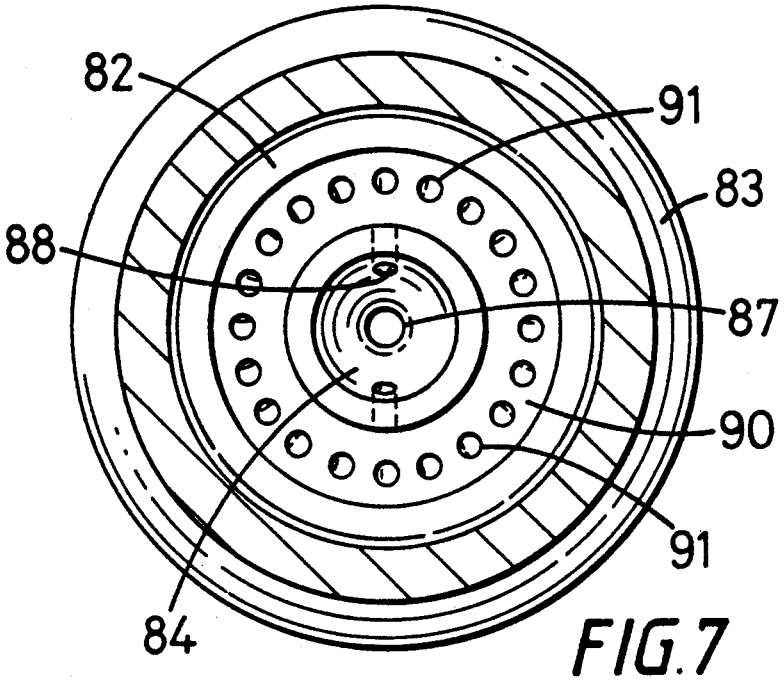
Figure 8:
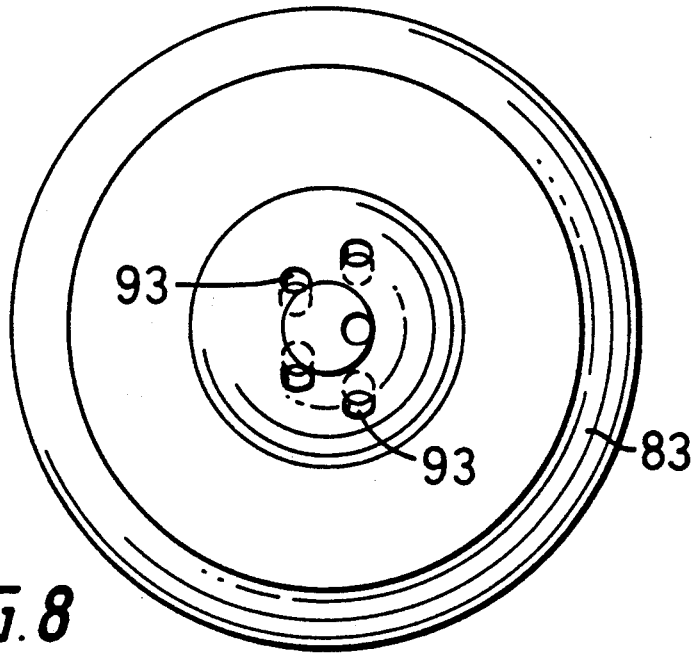
Figure 9:
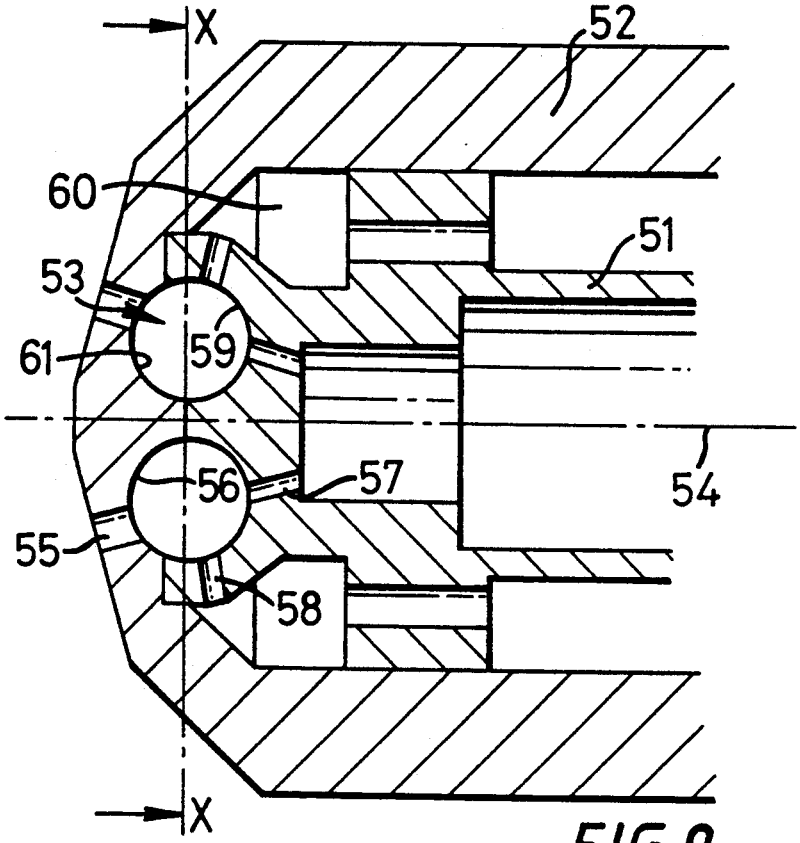
Figure 10:
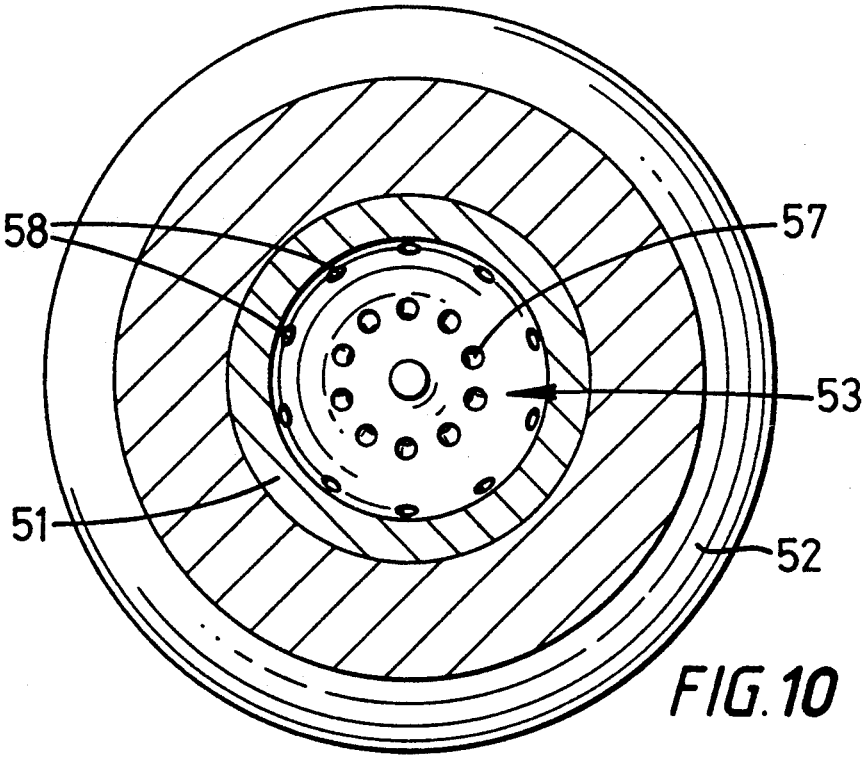
Figure 11:
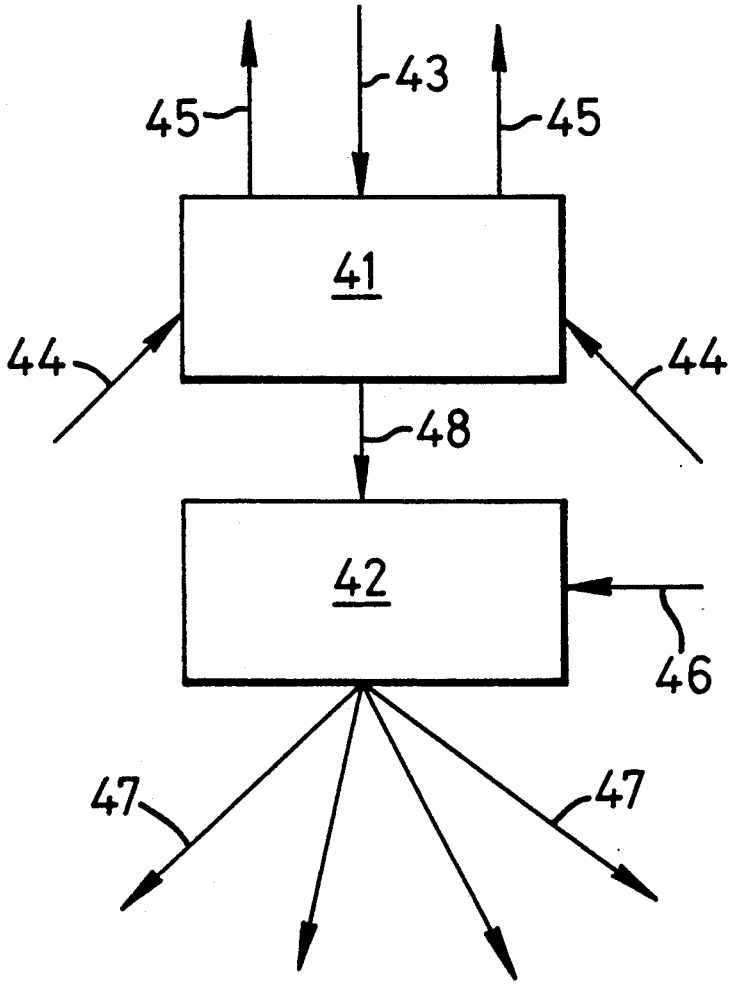
Figure 12:
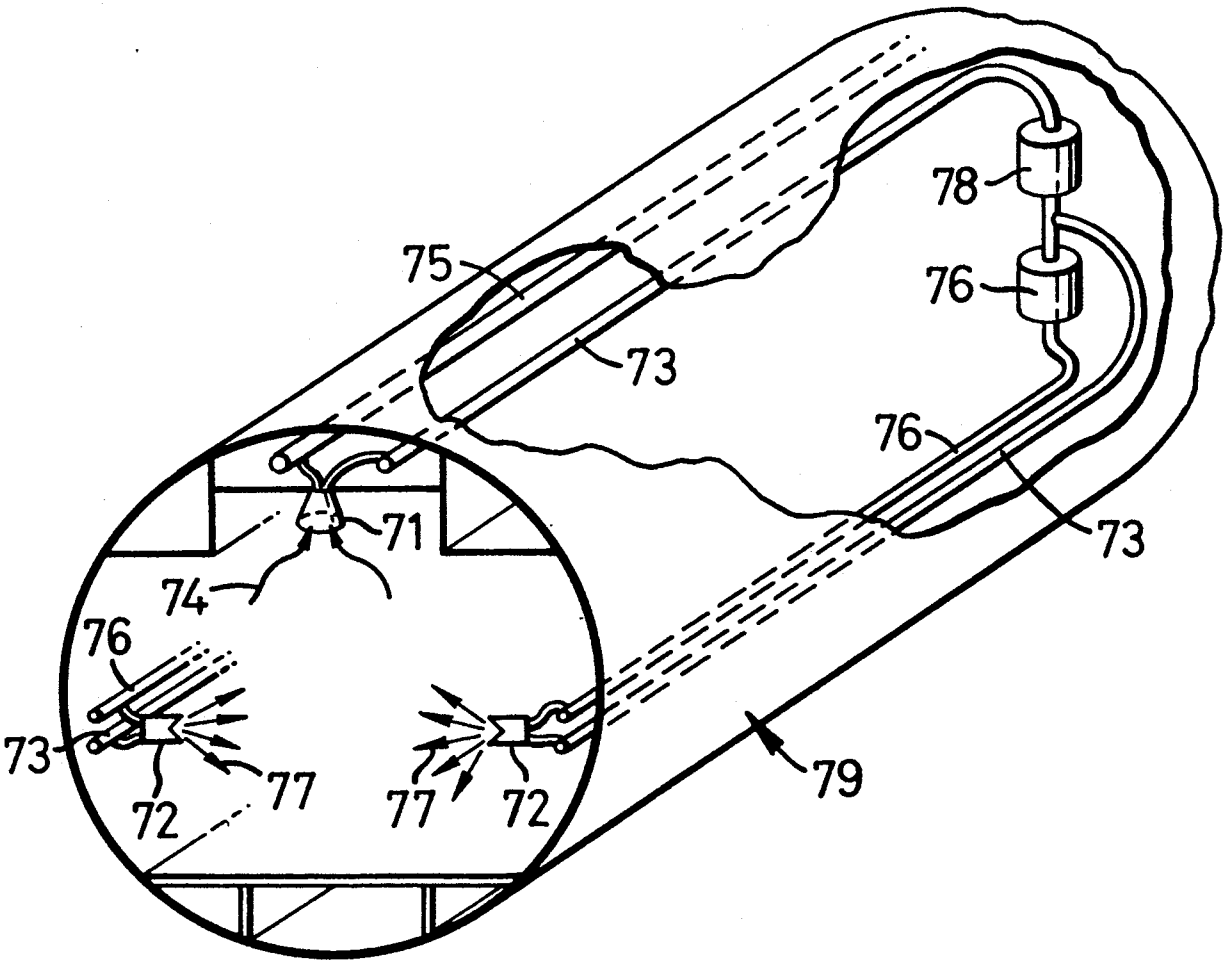

FIGS. 1 and 2 represent in cross-section spray nozzles from producing relatively long throw sprays according to the present invention. FIGS. 3 and 4 represent in longitudinal cross-section and end view respectively, a spray nozzle as in FIG. 2 but having a spray shape modifier. FIG. 5 shows in longitudinal cross-section a spray nozzle according to the present invention for producing a relatively long throw spray. FIG. 6 shows the same nozzle as in FIG. 5 in end view on B—B. FIG. 7 shows the nozzle in FIGS. 5 and 6 in cross-section along C—C. FIG. 8 shows in end view an alterative nozzle to that in FIG. 6 having only five outlets. FIGS. 9 and 10 represent in different cross-sections, a spray nozzle for producing a relatively short throw spray according to the present invention. FIG. 11 represents in schematic form a spray nozzle in combination with an extractor for use in a confined space according to the present invention. FIG. 12 represents in section and perspective, the interior of an aircraft cabin having spray nozzles and extractors according to the present invention.

In FIG. 1, a spray nozzle for producing a relatively long throw spray according to the present invention comprises a cylindrical mixing chamber (1) disposed about a longitudinal axis (2) and having a first end (3) with an axially directed gas inlet (4) and a second end (5) having an axially directed outlet (6). The mixing chamber also has two radially directed, liquid inlets (7) diametrically opposed on a plane (8) which is perpendicular to the longitudinal axis (2) of the mixing chamber (1). The outlet (6) being narrower than the mixing chamber (1) thereby defines a lip (9) which is contiguous with the inner surface (10) of the mixing chamber (1). The mixing chamber (1) also has a first zone (11) between the outlet (6) and the plane (8) of the liquid inlets. The mixing chamber (1) has a second zone (12) between the plane (8) of the liquid inlets and the gas inlet (4).

In use, a non-flammable gas, for example air, is supplied at pressure to the gas inlet (4) and a non-flammable liquid for example water, is supplied at pressure to the liquid inlets (7). It is believed that the pressurised gas entering the mixing chamber (1) shears the liquid entering through the liquid inlets and entrains most of the liquid to give a liquid dispersion in the gas in the first zone (11). As this dispersion leaves the mixing chamber through the outlet (6) it expands to form a spray. It is further believed that some liquid is retained in the mixing chamber and is recirculated until it ultimately leaves in the spray. Also, it is believed that some liquid coalesces on the inner surface (10) of the mixing chamber (1) and tends to be returned to the mixing chamber (1) due to the recirculation in the first zone (11) to be subsequently dispersed in the spray. The relative flows and pressures of gas and liquid are preferably adjusted so that recirculation does not take place in the second zone (12).

In FIGS. 2 to 4, a spray nozzle for producing a relatively long throw spray according to the present invention comprises an inner body (21) and an outer body (22) which may be assembled to define therebetween a mixing chamber (23) disposed about a longitudinal axis (24). The mixing chamber (23) has a first end (25) with an axially directed gas inlet (26) in the inner part (21). The mixing chamber (23) has a second (27) with an axially directed outlet (28). The mixing chamber also has two radially directed liquid inlets (29) in the inner part (21), diametrically opposed on a plane (30) which is perpendicular to the longitudinal axis (24) of the mixing chamber (23). The outlet (28) being narrower than the mixing chamber (23) thereby defines a lip (31) which is contiguous with the inner surface (32) of the mixing chamber (23). The mixing chamber (23) also has a first zone (33) between the outlet (28) and the liquid inlets (29) and a second zone (35) between the liquid inlets (29) and the gas inlet (26).

In use, a non-flammable gas, for example, air, is supplied to gas inlet (26) at sufficiently high pressure to achieve ultimately a spray having the desired throw and a non-flammable liquid, for example water, is supplied to the liquid inlets (29) through radial slots (34) in the inner body (21). It is believed that the gas entering the mixing chamber (23) shears the liquid entering through the liquid inlets (29) and entrains most of the liquid to give a liquid dispersion in the gas in the first zone (33). As this dispersion leaves the mixing chamber through the outlet (28) it expands to form a spray. It is further believed that some liquid is retained in the mixing chamber and is recirculated until it ultimately leaves in the spray. Also, it is believed that some liquid coalesces on the inner surface (32) of the mixing chamber (23) and tends to be returned to the mixing chamber (23) due to the recirculation in the first zone (33) to be subsequently dispersed in the spray. The relative flows and pressures of gas and liquid are preferably adjusted so that recirculation does not take place in the second zone (35).

It is envisaged that the nozzle shown in FIG. 2 may have a spray shape modifier on the outlet (28). Such a spray nozzle is shown in FIGS. 3 and 4. FIG. 3 is a longitudinal cross-section of the nozzle and FIG. 4 is an end view of the nozzle viewed on A—A. The spray shape modifier comprises a body (36) positioned in the center of the outlet (28) by three members (37). It has been found that such a modifier produces a gas-liquid spray of oval transverse cross-section with a spray angle ranging from 15° to 26°.

Using a spray nozzle such as FIG. 3 with 100 liters per minute of water and an air:water mass ratio of not greater than about 4:100, a spray with a throw of approximately 12 m was obtained in still air conditions. This spray extinguished a wooden crib fire. The back pressure on the water supply was no more than 12 barg. and the back pressure on the air supply was no more than 4 barg.

FIG. 5 shows in longitudinal cross-section a spray nozzle according to the present invention for producing a relatively long throw spray but not as long as that produced by the nozzles in FIGS. 1 to 4. FIG. 6 shows the same nozzle as in FIG. 5 in end view on B—B. FIG. 7 shows the nozzle in FIGS. 5 and 6 in cross-section along C—C. FIG. 8 shows in end view on B—B an alterative nozzle to that in FIG. 6 having only five outlets.

In FIGS. 5 to 8 the spray nozzle comprises an inner body (82) and an outer body (83) which may be assembled to define therebetween a truncated cone-shaped mixing chamber (84) disposed about a longitudinal axis (85). The mixing chamber has a first end (86) with an axially directed gas inlet (87) in the inner part (82). The mixing chamber has two radially directed liquid inlets (88) in the inner part, diametrically opposed on a plane (89) which is perpendicular to the longitudinal axis (85) of the mixing chamber (84). The liquid inlets are in fluidic communication with an annular chamber (90) through which liquid can flow from inlets (91). The mixing chamber (84) has a second end (92) with five or six outlets (93). The angles between the outlets for the six outlets configuration (FIG. 6) are all 30°. For the five outlets configuration (FIG. 8) the angles are 45° and 30°.

In use, a non-flammable gas, for example air, is supplied to gas inlet (87) at pressure. Non-flammable liquid for example water is supplied at pressure to the liquid inlets (88) via inlets (91) and chamber (90).

The resultant spray leaves the mixing chamber through outlets (93) to be directed to control the fire. This type of nozzle produces a spray having an oval transverse cross-section.

It is envisaged that a spray nozzle according to FIGS. 1 to 8 may have more than two liquid inlets. These liquid inlets may be equally disposed circumferentially aroung the mixing chamber to avoid any nett radial liquid flow in the mixing chamber, which may result in liquid coalescing on the walls of the mixing chamber.

In FIGS. 9 and 10, a spray nozzle for producing a relatively short throw spray according to the present invention comprises an inner body (51) and an outer body (52) which may be assembled to define therebetween a toroidal mixing chamber (53) disposed about a longitudinal axis (54). The mixing chamber (53) has a plurality of outlets (55) equally disposed circumferentially aroung one end (56) of the mixing chamber. The mixing chamber (53) also has a plurality of liquid inlets (58) and gas inlets (57) circumferentially disposed around the opposite end (59) of the mixing chamber, the gas inlets (57) being radially inside, and radially aligned with the liquid inlets (58). The gas and liquid inlets are directed so that gas and liquid flow through the inlets impinge on one another, there being equal numbers of gas inlets, liquid inlets and outlets. The mixing chamber (53) has a surface (61) capable of aiding mixing of gas and liquid introduced through the inlets (58), (57). The nozzle is shown in longitudinal cross-section in FIG. 9 and FIG. 10 shows the nozzle in cross-section viewed on X—X.

In use, a non-flammable liquid, for example water is supplied at pressure to the liquid inlets (58) via a liquid supply chamber (60) and a non-flammable gas, for example air, is supplied at pressure to the gas inlets (57). It is believed that the gas and the liquid are mixed in the mixing chamber (53) by shear and recirculation. The mixture of gas and liquid leaves the chamber through the outlets (55) in the form of a hollow cone spray.

To test the efficiency of the method and apparatus according to the present invention, spray nozzles having a relatively short throw as in FIGS. 9 and 10 were tested in a confined space. The confined space used was a converted shipping container. The container was 2.3 m wide, 2.6 m high, 12.0 m long. The container had 3 flues in the ceiling; a central flue 1.0 m in diameter and two other flues 0.6 m in diameter. The container also had reinforced walls and a water-cooled floor. A fire tray was positioned in the center of the container and was 1 m wide, 1 m long and 0.2 m deep. An outer tray 1.5 m square was provided around the fire tray for spillages. The container was provided with thermocouples. Four spray nozzles as in FIGS. 9 and 10 were positioned at about 1.8 m above the firs tray in a square pitch arrangement. Fire tests showed that with 8 liters of motor spirit in the fire tray temperatures reached their peak (about 900° C.) within 6 seconds from ignition and the fire reached its prime in terms of intensity, temperature and smoke after about 30 seconds from ignition. Using four spray nozzles with a total water supply of 20 liters/min at 80 psig and air supply of about 200 liters/min at 60 psig, good spray coverage of the fire tray was achieved. With the sprays activated at the end of the thirtieth second after ignition, the fire was extinguished more or less instantaneously using about 1 liter of water. The sprays were kept on for about 10 seconds and the environment was survivable 5 to 10 seconds after the sprays had been started. No fire reignition was observed in some 100 fire tests of various types. Subsequent tests showed that a 6 liter motor spirit fire could be extinguished with a single spray nozzle as in FIGS. 9 and 10. Reignition in this example was possibly prevented by formation of an oil/water emulsion.

Using the same confined space, tests were also performed to simulate fires under vehicles such as cars on a train. A metal plate was positioned over the fire tray so as to leave a flame gap of about 25 cm. Four spray nozzles of the type shown in FIG. 9 were positioned two at each side of the fire tray pointing at the gap between the plate and the fire tray. It was found that it took an average of about 4 seconds to extinguish a 9 liter gasoline fire using only 1.5 liters of water, up to 40% of which may have been wasted on the metal plate. By use of suitably shaped sprays such as shown in FIG. 5 this loss of water may be reduced. The spray nozzles also extinguished a very intense fire caused by a strong air current through the container. Another test demonstrated that a survivable environment could be maintained inside the container despite 30–40 liters of burning aviation kerosine outside adjacent the open container door, using 3 spray nozzles such as are shown in FIG. 5 with a total water supply of 15 l/min and a total air supply of 200 l/min both fluids at 5.5 barg (80 psig).

In FIG. 11, a combined spray nozzle/extractor for use in a confined space such as an aircraft has an extractor (41) driven by a stream of cool, clean, pressurised air (43) provided by a compressed air supply (not shown). The extractor (41) draws in hot, noxious fumes (44) from the region of the fire and exhausts them into extraction ducts (45). The air (48) leaving the extractor (41) passes to a spray nozzle (42) having a mixing chamber (not shown) and a supply (46) of pressurised water from the aircraft's on-board water supply (not shown). The air (48) and water (46) are mixed in the nozzle to produce a spray (47) of small water drops with a flow of clean air which may be directed to control the fire.

In FIG. 12 the fuselage (79) of an aircraft is fitted with spray nozzles (72) and extractors (71) for use in the method according to the present invention. In use, the spray nozzles (72) are supplied with cool, clean air from the aircraft's compressed air supply (73) and water from the aircraft's on-board water supply (76) which mix in the mixing chambers of the spray nozzles to produce a spray (77) of small water drops in a stream of air. Hot noxious fumes (74) are drawn up by the extractors (71), which are driven by the aircraft's compressed air supply (73), and are exhausted into an extraction duct (75). THe extractors may be located in areas where the hot noxious fumes are expected to collect i.e. the head space of the passenger cabin. The spray nozzles may be located in areas of higher fire risk such as toilet areas, or over the galley etc. A receiver (78) of pressurised air may be used to supply the pressurised air and to pressurise the water supply (76) so that the system may operate if the aircraft's engines are not running. It is envisaged that spray nozzles may also be fitted in place of conventional air conditioning vents above passenger seats in aircraft and could be designed to function in the same way as the existing units under normal flying conditions. In the event of a fire the nozzles would automatically take up their fire control role. Since the direction of air flow for aircraft air conditioning is often from overhead air jets to extraction vents mounted at or near floor level, it is envisaged that operation of the air conditioning system in a fire situation may require modification to accommodate the preferred direction of air flow for fire control. It is also envisaged that the extractors may form part of the aircraft's air conditioning/extraction system and may be driven not only by the aircraft's compressed air supply but also by the increased cabin pressure resulting from vaporisation of the water spray. Thereby, the extractors may be used to regulate the cabin pressure.

I claim:

1. A method of fire control by use of a spray nozzle, the method comprising the steps of(a) supplying to the spray nozzle separately and under pressure non-flammable gas, and non-flammable liquid, said spray nozzle having a mixing chamber with at least one gas inlet, at least one liquid inlet and at least one outlet, and said gas and liquid mixing in said mixing chamber with at least a part of the liquid being sheared and recirculated therein to produce a spray from said outlet and (b) directing said spray to control the fire.

2. A method of fire control according to claim 1 in which said gas and said liquid are supplied to a mixing chamber having two ends, said chamber having a gas inlet at one end and one or more outlets at the opposite end, and said mixing chamber having two or more liquid inlets between said gas inlet and said outlets and said mixing chamber having a zone between said liquid inlets and said outlets, and in which said gas and liquid mix in said zone to produce a spray which passes out through said outlets.

3. A method according to claim 1 in which said gas and liquid are supplied to a mixing chamber having a plurality of liquid inlets, a plurality of gas inlets, a plurality of outlets and an inner surface capable of aiding mixing of the gas and liquid.

4. A spray nozzle for use in fire control comprising a mixing chamber having at least one inlet for pressurized, non-flammable gas and at least one inlet for pressurized, non-flammable liquid said inlets being directed to supply, in use, pressurized, non-flammable gas and liquid to mix in said mixing chamber with at least a part of the liquid being sheared and recirculated therein and to produce a spray and said chamber having at least one outlet for the resultant spray.

5. A spray nozzle according to claim 4 in which said mixing chamber has two ends and said mixing chamber has a gas inlet at one end of said mixing chamber and one or more outlets at the opposite end of said mixing chamber, said mixing chamber having two or more liquid inlets between said gas inlet and said outlets and said mixing chamber having a zone between said outlets and said liquid inlets for said gas and liquid to mix.

6. A spray nozzle according to claim 5 in which said liquid inlets are equally spaced circumferentially around said mixing chamber.

7. A spray nozzle according to claim 5 in which said mixing chamber has a single outlet which is narrower than said mixing chamber.

8. A spray nozzle according to claim 5 in which said mixing chamber has a plurality of outlets directed to produce a spray of a required shape.

9. A spray nozzle according to claim 4 in which said mixing chamber has a plurality of liquid inlets, a plurality of gas inlets and a plurality of outlets, said mixing chamber having an inner surface capable in use, of aiding mixing of gas and liquid introduced through said inlets.

10. A spray nozzle according to claim 9 in which said inlets are directed such that in use, gas and liquid impinge on one another.

11. A spray nozzle according to claim 9 in which said mixing chamber has a longitudinal axis and said outlets are disposed circumferentially around one end of said axis.

12. A spray nozzle according to claim 9 in which said gas inlets and liquid inlets are disposed circumferentially around said mixing chamber.

13. A spray nozzle according to claim 9 in which said mixing chamber is toroidal in shape.

14. A spray nozzle according to claim 4 in which said spray nozzle has a spray shape modifier.

15. Apparatus for use in fire control, comprising one or more spray nozzles, each having a mixing chamber with at least one gas inlet, at least one liquid inlet and at least one outlet, and means for supplying pressurized, non-flammable gas to said gas inlets and means for supplying pressurized, non-flammable liquid to said liquid inlets so that in use said gas and liquid mix in said mixing chamber with at least a part of the liquid being sheared and recirculated therein to produce a spray from said outlet.

16. Apparatus according to claim 15 comprising extraction means which in use, is driven by said pressurised gas or liquid.

17. A vehicle having apparatus according to claim 15.

* * * * *